US006146696A

United States Patent [19]

Das et al.

[11] Patent Number: 6,146,696

[45] Date of Patent: Nov. 14, 2000

[54] PROCESS FOR SIMULTANEOUSLY ALUMINIZING NICKEL-BASE AND COBALT-BASE SUPERALLOYS

[75] Inventors: Nripendra N. Das, West Chester; Patricia A. Charles, Hamilton; Raymond W. Heidorn, Fairfield, all of Ohio

[73] Assignee: General Electric Company, Cincinnati, Ohio

[21] Appl. No.: 09/318,644

[22] Filed: May 26, 1999

[51] Int. Cl.[7] ..... C23C 16/08

[52] U.S. Cl. ..... 427/253; 427/255.26

[58] Field of Search ..... 427/253, 255.26

[56] References Cited

U.S. PATENT DOCUMENTS

| | | | |
|---|---|---|---|
| 3,415,672 | 12/1968 | Levinstein et al. | 427/250 |
| 3,486,927 | 12/1969 | Gauje | 427/253 |
| 3,540,878 | 11/1970 | Levine et al. | 148/421 |
| 3,978,251 | 8/1976 | Stetson et al. | 75/255 X |
| 4,004,047 | 1/1977 | Grisik | 29/402.18 X |
| 4,132,816 | 1/1979 | Benden et al. . | |
| 4,332,843 | 6/1982 | Ahuja . | |
| 5,441,767 | 8/1995 | DeSaulniers . | |
| 5,688,607 | 11/1997 | Rose et al. . | |

*Primary Examiner*—Timothy Meeks
*Attorney, Agent, or Firm*—Andrew C. Hess; Gerry S. Gressel

[57] ABSTRACT

A process for simultaneously vapor phase aluminizing nickel-base and cobalt-base superalloys within a single process chamber using the same aluminum donor and activator, to yield diffusion aluminide coatings of approximately equal thickness. The process entails the use of an aluminum donor containing about 50 to about 60 weight percent aluminum, and an aluminum fluoride activator present in an amount of at least 1 gram per liter of coating chamber volume. Nickel-base and cobalt-base superalloys are simultaneously vapor phase aluminized for 4.5 to 5.5 hours at a temperature of about 1900° F. to about 1950° F. in an inert or reducing atmosphere. With these materials and process parameters, diffusion aluminide coatings are developed on both superalloys whose thicknesses do not differ from each other by more than about 30%.

9 Claims, No Drawings

PROCESS FOR SIMULTANEOUSLY ALUMINIZING NICKEL-BASE AND COBALT-BASE SUPERALLOYS

FIELD OF THE INVENTION

This invention relates to processes for forming diffusion aluminide environmental coatings. More particularly, this invention is directed to a process for simultaneously vapor phase aluminizing nickel-base and cobalt-base superalloys within a single process chamber using the same aluminum donor and activator, to yield diffusion aluminide coatings of approximately equal thickness.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high temperature capabilities have been achieved through the development of nickel and cobalt-base superalloys, and through the use of oxidation-resistant environmental coatings capable of protecting superalloys from oxidation, hot corrosion, etc.

Diffusion aluminide coatings have found wide use as environmental coatings. Diffusion aluminides are generally single-layer oxidation-resistant coatings formed by a diffusion process, such as a pack cementation or vapor (gas) phase deposition, both of which generally entail reacting the surface of a component with an aluminum-containing gas composition. Examples of pack cementation processes are disclosed in U.S. Pat. Nos. 3,415,672 and 3,540,878, assigned to the assignee of the present invention and incorporated herein by reference. In pack cementation processes, the aluminum-containing gas composition is produced by heating a powder mixture of an aluminum-containing donor material, a carrier (activator) such as an ammonium or alkali metal halide, and an inert filler such as calcined alumina. The inert filler is required to prevent powder sintering and promote a uniform distribution of the volatile halide compound around the component, so that a diffusion aluminide coating of uniform thickness is produced. The activator is typically a fluoride or chloride powder, such as $NH_4F$, NaF, KF, $NH_4Cl$ or $AlF_3$. While pack cementation processes may use the same donor material to aluminize nickel-base and cobalt-base superalloys, a lower amount of donor must be used for nickel-base substrates as compared to cobalt-base substrates.

The ingredients of the powder mixture are mixed and then packed and pressed around the component to be treated, after which the component and powder mixture are typically heated to about 1200–2200° F. (about 650–1200° C.), at which the activator vaporizes and reacts with the donor material to form the volatile aluminum halide, which then reacts at the surface of the component to form the diffusion aluminide coating. The temperature is maintained for a duration sufficient to produce the desired thickness for the aluminide coating.

Aluminum-containing donor materials for vapor phase deposition processes can be an aluminum alloy or an aluminum halide. If the donor is an aluminum halide, a separate activator is not required. The donor material is placed out of contact with the surface to be aluminized. As with pack cementation, vapor phase aluminizing (VPA) is performed at a temperature at which the aluminum halide will react at the surface of the component to form a diffusion aluminide coating.

The rate at which a diffusion aluminide coating develops on a substrate is dependent in part on the substrate material, donor material and activator used. If the same donor and activator are used, nickel-base substrates have been observed to develop a diffusion aluminide coating at a faster rate than cobalt-base substrates. To achieve comparable coating rates, cobalt-based alloys have required higher aluminum activity in the coating chamber, necessitating that different donor materials and/or activators be used. For example, donors with lower aluminum contents (typically chrome-aluminum alloys containing about 30% aluminum by weight) have often been used to coat nickel-base superalloys, while donors with higher aluminum contents (e.g., 45% by weight) have been used for cobalt-base superalloys. Consequently, components formed of a combination of nickel and cobalt superalloys typically have not been aluminized in a single process, but have been required to undergo separate aluminizing steps with the result that considerable additional processing time and costs are incurred.

BRIEF SUMMARY OF THE INVENTION

The present invention generally provides a process for simultaneously vapor phase aluminizing nickel-base and cobalt-base superalloys within a single process chamber using the same aluminum donor and activator, to yield diffusion aluminide coatings of approximately equal thickness. According to this invention, certain donor materials and activators in combination with a narrow range of process parameters are necessary to achieve the benefits of this invention. More particularly, the process of this invention entails placing one or more nickel-base and cobalt-base substrates in a chamber that contains an aluminum-containing donor and an aluminum halide activator. The aluminum donor must contain about 50 to about 60 weight percent aluminum, while the aluminum halide activator must be aluminum fluoride present within the chamber in an amount of at least 1 gram per liter of chamber volume. The nickel-base and cobalt-base substrates are then vapor phase aluminized for 4.5 to 5.5 hours at a temperature of about 1900° F. to about 1950° F. (about 1038° C. to about 1066° C.) in an inert or reducing atmosphere.

According to the invention, these materials and process parameters are able to simultaneously develop diffusion aluminide coatings on nickel-base and cobalt-base substrates, such that the coating thicknesses on the substrates do not differ significantly from each other, preferably by not more than about 30%. As a result, gas turbine engine components, such as high pressure turbine nozzles having nickel-base superalloy airfoils and cobalt-base superalloy inner and outer bands, can be aluminized in a single treatment cycle to have a uniform diffusion aluminide coating whose thickness is sufficient to protect the component from the hostile environment of a gas turbine engine.

Other objects and advantages of this invention will be better appreciated from the following detailed description.

DETAILED DESCRIPTION OF THE INVENTION

The present invention is generally directed to diffusion aluminide environmental coatings for components that must operate within environments characterized by relatively high temperatures, and are therefore subjected to severe oxidation and hot corrosion. While developed for gas turbine engine components, and particularly high pressure turbine nozzles with nickel-base superalloy airfoils welded to cobalt-base superalloy inner and outer bands, the teachings of this invention are generally applicable to any situation in which it is desired to simultaneously aluminize nickel-base and cobalt-base alloys.

The present invention is a vapor phase aluminizing process whose process materials and parameters have been found to simultaneously develop diffusion aluminide coatings of approximately equal thickness on nickel-base and cobalt-base alloys. Accordingly, this invention overcomes the principal obstacle to vapor phase aluminizing nickel-base and cobalt-base superalloys with a single treatment cycle. The specific process requirements that have been identified as being necessary for the success of this invention include the use of an aluminum-containing donor containing about 50 to about 60 weight percent aluminum, aluminum fluoride in amounts of at least 30 grams per $ft^3$ (about 1g/l ) of chamber volume as the activator, and a treatment temperature and duration of about 1900° F. to about 1950° F. (about 1038° C. to about 1066° C.) and about 4.5 to 5.5 hours, respectively. According to the invention, deviation of any one of the above parameters can result in diffusion aluminide coatings of significantly different thicknesses being developed.

While various aluminum-containing donor materials having the aluminum content required by this invention could foreseeably be used, preferred aluminum donor materials are cobalt-aluminum alloys, and particularly $Co_2Al_5$ (aluminum content of about 53% by weight). The use of a cobalt-aluminum alloy for aluminiding a nickel-base substrate is contrary to the prior practice of using chrome-aluminum alloys for nickel-base substrates. Nonetheless, cobalt-aluminum alloys are preferred for simultaneously coating nickel-base and cobalt-base substrates in accordance with this invention.

Aluminum fluoride has been used in the past as the activator for aluminizing nickel-base and cobalt-base substrates by pack cementation and vapor phase deposition. According to this invention, aluminum fluoride must be present in amounts of at least 30 grams per $ft^3$ (about 1g/l ) of chamber volume in order to achieve approximately equal coating rates on both nickel-base and cobalt-base substrates. A preferred amount of aluminum fluoride activator for use in this invention is between 30 and 60 grams per $ft^3$ (about 1 and 2 g/l ) of chamber volume.

The activity of an aluminizing process is known to be directly proportional to the activator concentration and the amount of aluminum present in the donor alloy. Therefore, aluminum activity determines the coating thickness formed on a given substrate if the duration of the coating process is held constant. In the past, lower aluminum activity was required to coat nickel-base substrates at a rate comparable to cobalt-base substrates. Though these conventions would suggest that different types or amounts of donor material and/or activator would be required to produce diffusion aluminide coatings of comparable thicknesses on cobalt-base and nickel-base substrates in a single coating cycle, the present invention is based on the unexpected determination that the very same donor material and activator can be used to simultaneously coat cobalt-base and nickel-base substrates if the aluminum content of the donor is sufficiently high, the activator is aluminum fluoride, and the temperature of the process is maintained within a narrow range.

During an investigation leading to this invention, high pressure turbine nozzles having nickel-base superalloy airfoils joined between cobalt-base inner and outer bands were vapor phase aluminized (VPA) using parameters within conventional VPA processing ranges for cobalt-base and nickel-base substrates (Prior Art "A" and "B", respectively), and using the processing parameters of this invention ("Invention"). The airfoils were formed of Rene 142 Ni-base alloy, while the inner and outer bands were formed of X-40 Co-base alloy, though other nickel-base and cobalt-base refractory alloys could have been used with similar results. The vapor phase deposition parameters used are outlined below.

TABLE I

| | PRIOR ART | | |
|---|---|---|---|
| PARAMETER | A | B | INVENTION |
| Temp.: | 1080–1100° C. | 1080–1100° C. | 1040° C. |
| Duration: | 6.0 hrs. | 6.0 hrs. | 5.0 hrs. |
| Donor: | $Co_2Al_5$ | CrAl | $Co_2Al_5$ |
| Activator: | $AlF_3$ | $AlF_3$ | $AlF_3$ |
| Concentration*: | 0.8–2.0 g/l | 0.3–0.6 g/l | 1.2 g/l |

*Concentration in grams of activator per liter of coating container volume.

As noted previously, the above parameters are those critical to the invention. Each process was performed in the same commercial apparatus with a hydrogen and argon atmosphere, though essentially any inert or reducing atmosphere would be acceptable.

The above parameters of this invention yielded a diffusion aluminide coating on the nickel-base superalloy surfaces of about 70 $\mu$m in thickness, and a diffusion aluminide coating on the cobalt-base superalloy surfaces of about 55 $\mu$m in thickness. In comparison, the diffusion aluminide coatings produced using the prior art parameter ranges "A" (conventionally used for cobalt-base superalloys) were about 115 $\mu$m in thickness on the nickel-base superalloy surfaces and about 60 $\mu$m in thickness on the cobalt-base superalloy surfaces, and the coatings produced using the prior art parameter ranges "B" (conventionally used for nickel-base superalloys) were about 60 $\mu$m in thickness on the nickel-base superalloy surfaces and about 25 $\mu$m in thickness on the cobalt-base superalloy surfaces. In summary, the process parameters of this invention developed diffusion aluminide coatings whose thicknesses differed by only about 30%, in comparison to a difference of about 100% for the process parameters of the prior art.

The above results evidenced that diffusion aluminide coatings of nearly identical thickness could be produced on both nickel-base and cobalt-base substrates using the VPA process of this invention. Such a capability was not possible with VPA processes using conventional process materials and parameters. The above also evidences that the effect of changing any single parameter is dependent on the other parameters, with the result that the deposition rate achievable with a given set of parameters is generally unpredictable. As a result, the discovery by this invention of optimum values for simultaneously coating nickel-base and cobalt-base substrates could not have been expected from prior art practices.

While our invention has been described in terms of a preferred embodiment, it is apparent that other forms could be adopted by one skilled in the art. Accordingly, the scope of our invention is to be limited only by the following claims.

What is claimed is:

1. A process for simultaneously forming diffusion aluminide coatings on surfaces of nickel-base and cobalt-base substrates, the process comprising the steps of:

placing a nickel-base substrate and a cobalt-base substrate in a chamber; and then subjecting the nickel-base and cobalt-base substrates to a vapor phase deposition process performed at about 1900° F. to about 1950° F. for a duration of 4.5 to 5.5 hours in an inert or reducing atmosphere, the vapor phase deposition process using an aluminum-containing donor and an aluminum halide activator, the aluminum-containing donor containing about 50 to about 60 weight percent aluminum, the aluminum halide activator being aluminum fluoride present within the chamber in an amount of at least 1 gram per liter of chamber volume, the nickel-base and cobalt-base substrates developing diffusion aluminide coatings thereon, wherein the diffusion aluminide coatings that develop on the nickel-base and cobalt-base substrates have thicknesses that do not differ from each other by more than 30%.

2. A process as recited in claim 1, wherein the aluminum-containing donor comprises $Co_2Al_5$.

3. A process as recited in claim 1, wherein the aluminum-containing donor consists of $Co_2Al_5$.

4. A process as recited in claim 1, wherein the nickel-base and cobalt-base substrates are members of a gas turbine engine component.

5. A process as recited in claim 1, wherein the gas turbine engine component is a high pressure turbine nozzle having a nickel-base superalloy airfoil and cobalt-base superalloy inner and outer bands.

6. A process for simultaneously forming diffusion aluminide coatings on a gas turbine engine component having nickel-base and cobalt-base superalloy substrates, the process comprising the steps of:

placing the gas turbine engine component in a chamber with an aluminum-containing donor and an aluminum fluoride powder, the aluminum-containing donor consisting essentially of 50 to 60 weight percent aluminum and the balance cobalt, the aluminum fluoride powder being present within the chamber in an amount of 1 to 2 grams per liter of chamber volume; and then subjecting the nickel-base and cobalt-base superalloy substrates to a vapor phase deposition process performed at about 1900° F. to about 1950° F. for a duration of 4.5 to 5.5 hours in an inert or reducing atmosphere, the nickel-base and cobalt-base superalloy substrates developing diffusion aluminide coatings whose thicknesses do not differ from each other by more than 30%.

7. A process as recited in claim 6, wherein the aluminum-containing donor comprises $Co_2Al_5$.

8. A process as recited in claim 6, wherein the aluminum-containing donor consists of $Co_2Al_5$.

9. A process as recited in claim 6, wherein the gas turbine engine component is a high pressure turbine nozzle having a nickel-base superalloy airfoil and cobalt-base superalloy inner and outer bands.

* * * * *